US011116339B2

(12) United States Patent
Tuominen

(10) Patent No.: US 11,116,339 B2
(45) Date of Patent: Sep. 14, 2021

(54) DRINKING GLASS FOR DISTILLED ALCOHOLIC BEVERAGE

(71) Applicant: Noble Glass Oy, Järvenpää (FI)

(72) Inventor: Jari Tuominen, Järvenpää (FI)

(73) Assignee: Noble Glass Oy, Järvenpää (FI)

( * ) Notice: Subject to any disclaimer, the term of this patent is extended or adjusted under 35 U.S.C. 154(b) by 36 days.

(21) Appl. No.: 16/490,190

(22) PCT Filed: Mar. 2, 2017

(86) PCT No.: PCT/FI2017/050134
§ 371 (c)(1),
(2) Date: Aug. 30, 2019

(87) PCT Pub. No.: WO2018/158490
PCT Pub. Date: Sep. 7, 2018

(65) Prior Publication Data
US 2020/0008597 A1 Jan. 9, 2020

(51) Int. Cl.
*A47G 19/22* (2006.01)

(52) U.S. Cl.
CPC ..... *A47G 19/2205* (2013.01)

(58) Field of Classification Search
CPC ..... A47G 19/2205; A47G 19/22; A47G 400/045; A47G 400/04; A47G 2400/045; A47G 19/2255; A47G 2400/04; B01F 2215/0072
USPC ..... 220/703
See application file for complete search history.

(56) References Cited

U.S. PATENT DOCUMENTS

| | | | | |
|---|---|---|---|---|
| D624,438 | S * | 9/2010 | Diss | D9/774 |
| 2006/0169700 | A1* | 8/2006 | Mansfield | A47G 19/2205 220/506 |
| 2007/0125720 | A1 | 6/2007 | Stecca | |
| 2007/0267422 | A1* | 11/2007 | Barducci | A47G 19/2233 220/608 |
| 2008/0290101 | A1* | 11/2008 | Stecca | A47G 19/2205 220/703 |
| 2013/0273224 | A1* | 10/2013 | Manska | B01D 1/30 426/493 |

FOREIGN PATENT DOCUMENTS

| | | | |
|---|---|---|---|
| CN | 201557891 | U | 8/2010 |
| CN | 104083052 | A | 10/2014 |
| CN | 204264756 | U | 4/2015 |
| CN | 105584703 | A | 5/2016 |
| FR | 2788210 | A1 | 7/2000 |
| JP | H11196994 | A | 7/1999 |
| WO | 2005/120306 | A1 | 12/2005 |
| WO | 2013/002972 | A1 | 1/2013 |
| WO | 2016/095949 | A1 | 6/2016 |

* cited by examiner

*Primary Examiner* — King M Chu
(74) *Attorney, Agent, or Firm* — Meunier Carlin & Curfman LLC

(57) ABSTRACT

A drinking glass for serving distilled alcoholic drinks includes a bottom and a wall, the wall including a choke. At the choke, a cross-sectional area of the wall is smaller than a cross-sectional area of the wall at an upper edge of the wall, which is, at the rim of the drinking glass. The wall is provided with at least one formation for the distilled alcoholic drink, on an inside face of the wall, between the choke and the upper edge of the wall.

12 Claims, 2 Drawing Sheets

DRINKING GLASS FOR DISTILLED ALCOHOLIC BEVERAGE

PRIORITY

Figure 1:
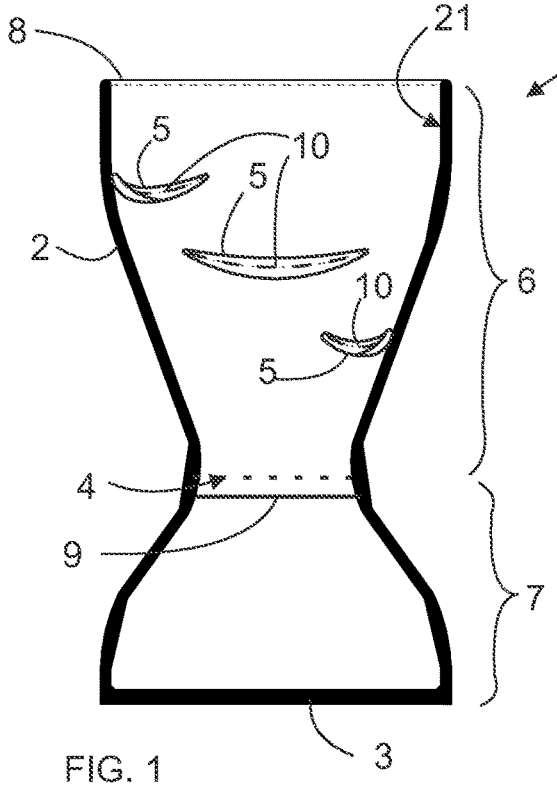

This application is a U.S national application of the international application number PCT/FI2017/050134 filed on Mar. 2, 2017.

TECHNICAL FIELD

This invention relates to drinking glasses intended for serving distilled alcoholic drinks.

PRIOR ART

Whiskey is the most popular strong alcoholic drink in the world. Its production has a long tradition. The drink differs from wines, for example, in the way that it is made, stored and composed. Because distillation is used in the production of whiskey, whiskey is a distilled alcoholic drink. Gin, rum, cognac and calvados are examples of other distilled drinks.

Whiskey contains approximately 40% ethanol and 60% water. The content of other compounds is less than 1%. However, this 1% gives each whiskey its distinctive characteristics that greatly affect how pleasant we find it in both smell and taste. Both ethanol and water are good solvents but dissimilar from each other. In addition to these main components, whiskey contains over 1000 different compounds.

Whiskey is served in a drinking glass the basic shape of which is a wide lower section and an upper section that is narrower than the lower section. That is, the shape of the drinking glass resembles that of a tulip. The purpose of this structure is to better keep the aromas given off by the whiskey in the drinking glass, in order to give a stronger smell experience while having the drink, and, thus, a stronger overall drinking experience.

For the sense of smell, approximately 100 of the compounds are interesting—they give the sensation that the so-called "tastings" aim at. The shape of the drinking glass is intended to contribute to the sensing of these and the other compounds. When having whiskey, and other distilled alcoholic drinks as well, many people, such as those who rarely have a drink, as well as women, have the problem that they find it very hard to sense anything else than the strong, mouth-burning ethanol. However, there are many interesting compounds behind the ethanol, providing a variety of pleasant smell experiences.

BRIEF DESCRIPTION

The objective of the invention is to provide a drinking glass enhancing the drinking pleasure of whiskey or other distilled alcoholic drinks. The objective is achieved as described in the independent claim. The dependent claims disclose different embodiments of the invention.

The invention is based on the idea of decreasing the portion of ethanol in the gaseous phase present in the drinking glass before the user of the drinking glass smells the scents of the distilled alcohol drink, coming from the drinking glass. This makes it easier to detect the scents of the other compounds of the drink.

The inventive drinking glass intended for serving distilled alcoholic drinks comprises a bottom and a wall, the wall comprising a choke. At the choke, the cross-sectional area of the wall is smaller than the cross-sectional area of the wall at the upper edge of the wall, that is, at the rim of the drinking glass. The wall is provided with at least one formation for the distilled alcohol drink, on the inside face of the wall, between the choke and the upper edge of the wall. The formation(s) is (are) constituted by a recess or a protrusion on the inside face of the wall of the drinking glass When a drink is poured into the drinking glass, some of the drink is left on the upper face(s) of the formation(s). The ethanol is able to quite quickly evaporate from the drink left on the upper face(s) of the formation(s), allowing the other scents of the other compounds of the drink, present on the upper face(s), to be more clearly detected. The cross-sectional area of the choke, in turn, restricts the evaporation of the ethanol of the liquid-phase drink beneath the choke into a gas phase in the space above the choke. Therefore, compared to the known solutions, the amount of the other compounds of the drink contained in the gas phase in the upper space of the drinking glass is relatively greater than that of the ethanol. This enhances the drinking pleasure.

The formation(s) on the inside face of the glass can be constituted by a plane extending horizontally, or in some other angle, in relation to the vertical direction of the drinking glass. The formation can also be constituted by a concave surface on the inside face of the glass. Besides, a recess can be provided in the upper face or the lower face of the plane.

LIST OF FIGURES

Figure 2:
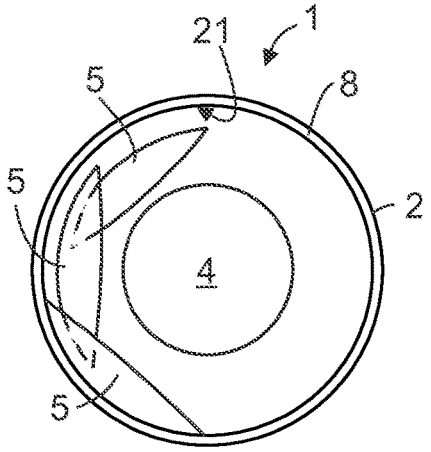
Figure 3:
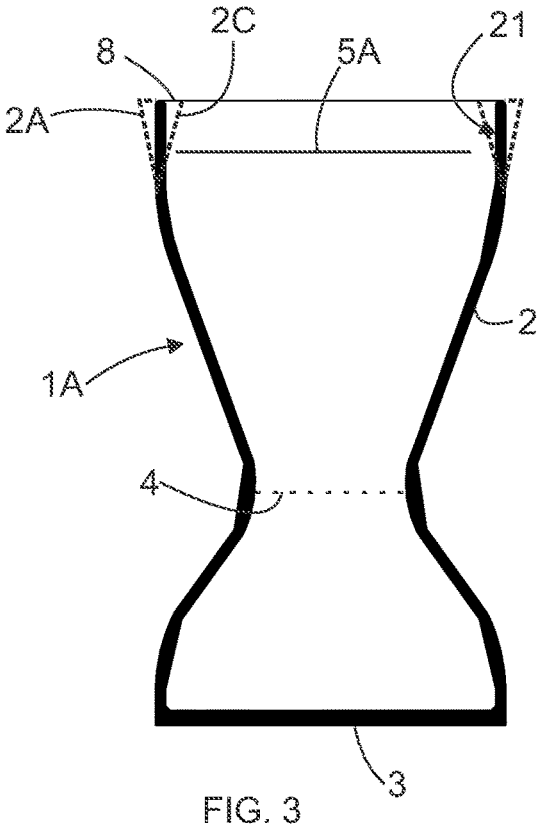
Figure 4:
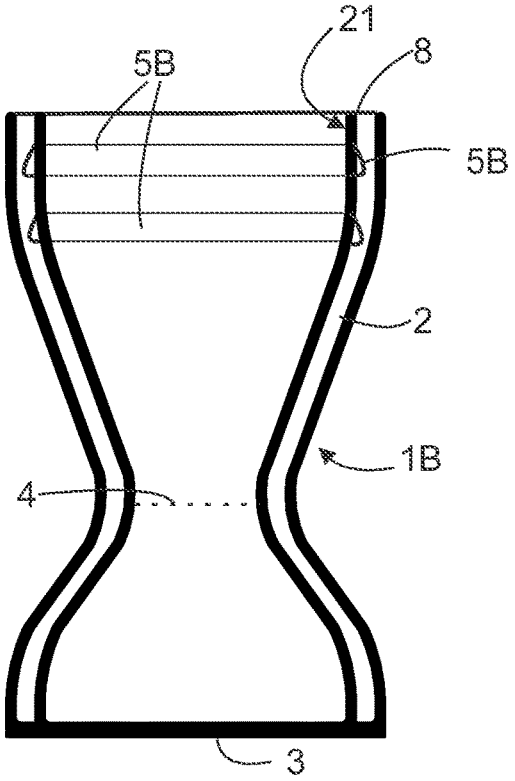
Figure 5:
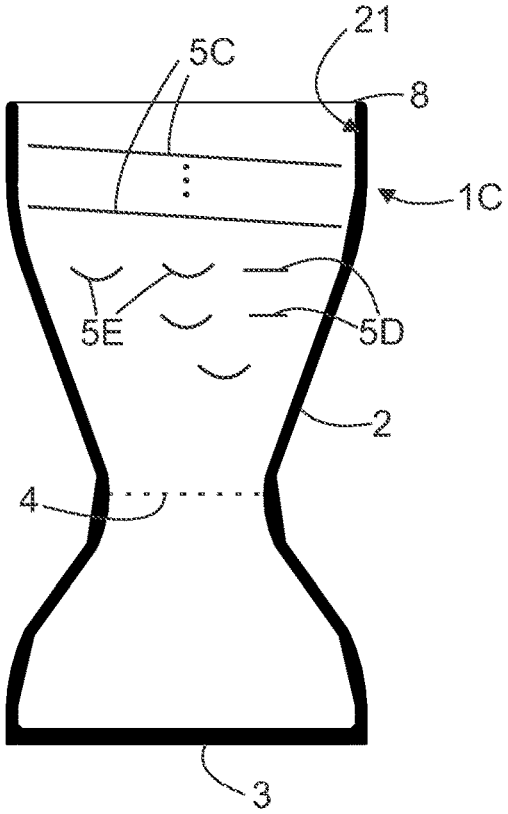
Figure 6:
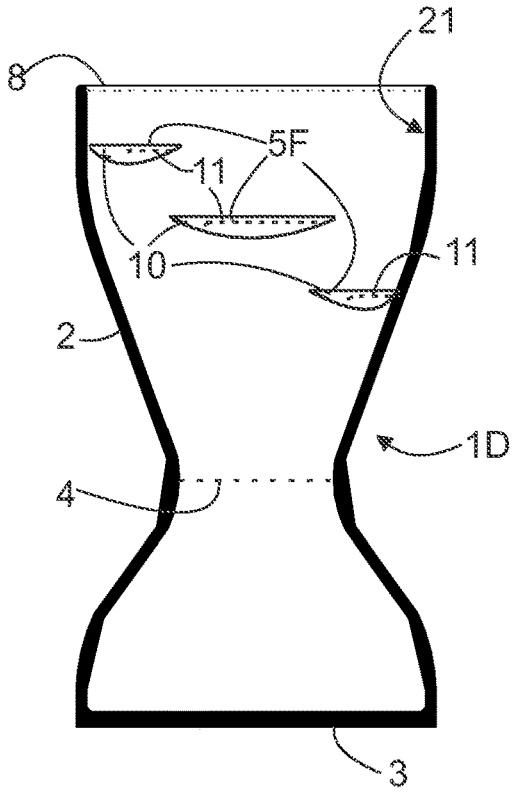
Figure 7:
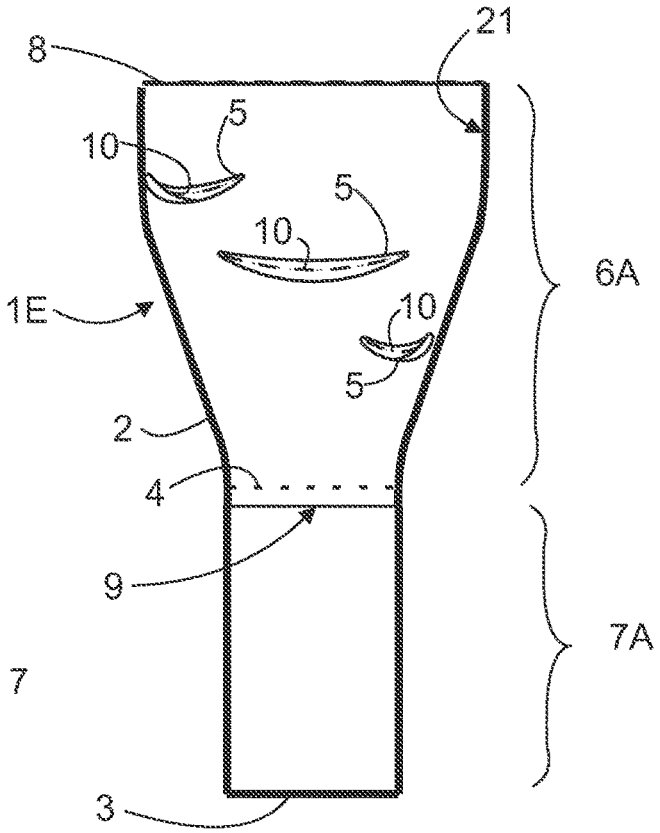

In the following, the invention will be described in more detail with reference to the drawing wherein FIG. 1 shows an example of the drinking glass according to the invention, FIG. 2 is a top view of the example of FIG. 1, FIG. 3 shows a second example of the drinking glass according to the invention, FIG. 4 shows a third example of the drinking glass according to the invention, FIG. 5 shows a fourth example of the drinking glass according to the invention, FIG. 6 shows a fifth example of the drinking glass according to the invention, and FIG. 7 shows a sixth example of the drinking glass according to the invention.

DESCRIPTION OF THE INVENTION

FIG. 1 shows an example of the drinking glass 1 for serving distilled alcoholic drinks according the invention. FIG. 2 is a top view of the drinking glass of FIG. 1.

The drinking glass 1 comprises a bottom 3 and a wall 2. The wall comprises a choke 4 where the cross-sectional area of the wall is smaller than the cross-sectional area of the wall at the upper edge 8 of the wall. Herein, the cross-sectional area refers to the area that the wall defines at a given point on the drinking glass, in the vertical direction thereof. FIG. 2 shows clearly that the cross-sectional area of the choke is smaller than the cross-sectional area of the wall at the rim 8 (upper edge) of the glass. Thus, seen from the choke, the drinking glass widens towards its upper edge. In the Figures, the choke, that is, the point where the cross-sectional area of the drinking glass is smallest, is designated by a dashed line.

The wall is provided with at least one formation 5 for the distilled alcohol drink, on the inside face 21 of the wall 2, between the choke 4 and the upper edge 8 of the wall. The formation can be constituted by a recess or a protrusion on the inside face of the drinking glass, that is, the formation is either a protrusion extending from the inside face 21 of the wall, or, a recess extending towards the interior of the wall. The recessed formation can be contemplated especially where the wall 2 of the glass is fairly thick, or, consists of two walls with an empty space between them, for example. FIGS. 1 and 2 show formations constituted by projections. FIG. 4 shows formations 5B constituted by recesses. The embodiment shown in FIG. 3 comprises one formation 5A but the inventive drinking glass may also comprise several formations, as appears from the embodiments shown in the other Figures.

FIGS. 3 to 6 show different formations provided on the inside face 21 of the drinking glass 1A, 1B, 1C, 1D, 1E. The formation can be constituted by a plane 5A extending horizontally in relation to the vertical direction of the drinking glass, as appears from FIG. 4. The vertical direction refers to a straight line from the bottom 3 of the glass up to the upper edge 8 of the glass. The plane can be also be a plane 5C extending in some other angle in relation to the vertical direction of the drinking glass and provided on the inside face of the glass, as appears from FIG. 5. The angled plane 5C may also form a spiral on the inside face of the glass, provided that the plane has such a length that the plane runs around the inside face of the glass. The plane 5D may also be fairly short. FIG. 5 illustrates, by the way of example, how a variety of formations are provided on the same glass. It should be appreciated that this glass does not necessarily correspond to a real glass in use although it is possible to provide different formations on the same glass. However, for the manufacture of the drinking glass, it may be convenient to only provide one type of formations on the inside face of the drinking glass.

The formation can also be constituted by a concave surface 5E on the inside face of the glass, as illustrated in FIG. 5. The formations can also be placed on the inside face 21 of the glass as desired. It is possible to place at least two formations at different heights in the vertical direction of the drinking glass. Further, the formations at the different heights can be placed in the same line with, or, in a different line from each other, in the vertical direction of the drinking glass. Further, the formations placed at the different heights and in the different vertical lines may overlap, that is, partly extend over one another, in the vertical direction of the drinking glass.

Besides, a recess 10 can be provided in the upper face of the plane, as shown in FIGS. 1, 6 and 7. The recess of the plane can be also be provided in the lower face thereof, if the plane is constituted by a recess towards the interior of the wall, as illustrated in FIG. 4. The recess helps to keep the drink on the plane. The volume of the recess can be dimensioned as desired. The volume of the recess of the upper face of the formation can be dimensioned to be 0.1 ml, for example.

The formations can be placed on the inside face of the drinking glass as desired. As an example, the formations can only be placed on one side of the drinking glass, as illustrated in FIG. 2. The example shown in FIG. 2 (and FIG. 1) comprises three formations 5 on the inside face of the glass. Each formation extends at a different height and in a different line in the vertical direction. Besides, seen from the central axis of the drinking glass, the three formations are located within a sector of 180 degrees. The side of the drinking glass that is provided with the formations is used for enjoying the scents of the drink. The opposite side of the drinking glass can be used for drinking the drink if the user finds it good to do so. The embodiments shown in FIGS. 1 and 2 illustrate as well that the formations placed at the different heights also can overlap in the height direction.

The upper (or lower) face of the formations may comprise a groove 11 to the one end of the formation. The groove helps any liquid present on the upper or lower face of the formation run out of the formation, after which it runs down along the inner wall 21 of the drinking glass and possibly down onto a formation at a lower height. This results in a visible stream of the drink from one formation to another, especially if the drinking glass is moved. This streaming may also enhance the drinking pleasure and the detection of the different compounds of the drink by smelling. FIG. 6 shows an exemplary formation 5F having both a groove 11 and a recess 10 in the upper face of the formation. That is, the groove has not only a visual effect but also a physical effect because it allows the liquid to move, thus encouraging faster evaporation.

FIG. 3 also illustrates different embodiments of the wall 2 of the drinking glass in the proximity of the upper edge 8 of the drinking glass. The wall 2 may extend straight upwards or turn outwards 2A or turn inwards 2C. The shape of the wall in the proximity of the upper edge 8 affects the appearance of the drinking glass. In all of the embodiments, the cross-sectional area is larger at the upper edge 8 of the wall than at the choke 4. The shape of the upper edge may also have some effect on the drinking experience.

The volume 7, 7A of the drinking glass between the bottom 3 of the drinking glass and the lower side of the choke 4 is dimensioned for the liquid phase. The volume 6, 6A above the choke 4 is intended for the gaseous phase. FIGS. 1 and 7 show the upper surface 9 of the liquid phase of the drink. It is practical that the volume of the drinking glass between the bottom of the drinking glass and the lower side of the choke is at least 4 to 5 cl but the volume may also be greater, and, possibly even smaller. However, 4 to 5 cl is a convenient volume for so-called tasting purposes, for example.

As appears from the example shown in FIGS. 1 to 6, the area 4 of the choke is smaller than the area of the inside face of the bottom 3. In other words, seen from the choke, the drinking glass widens towards the bottom. However, this shape of the lower section of the drinking glass is not the only way of implementation, although it is a convenient one. As an example, the area 4 of the choke may be as large as the area of the inside face of the bottom of the drinking glass, in accordance with the example shown in FIG. 7. It is more important that the volume of the lower section 7, 7A is sufficient for the liquid phase of the drink.

The high ethanol content of a distilled alcoholic drink may cause the smell receptors of the sense of smell to partly lose their ability to detect other scents. The invention allows the ethanol to fracture, that is, to separate from the other compounds before sensing the scents of the drink. This separation can be enhanced by confining the drink in the solution space, that is, in the space 7, 7A in the lower section of the drinking glass, by means of an ice cube, and, by allowing the ethanol to evaporate from the drink by means of the formations 5, 5A, 5B, 5C, 5D, 5E, 5F provided on the inside face 21 of the drinking glass. That is, the ice cube is positioned at the choke 4. The ice cube can be hemispherical. As the ice cube starts to melt, it creates a water layer between the ice and the wall 21 of the drinking glass. This functions as kind of a seal and prevents the ethanol from being transferred into the gaseous phase in the upper section of the glass. The ice cube should conveniently be dimensioned to melt in less than 10 minutes. The volume of the ice cube is dimensioned to produce 2 cl water during its melting.

This amount of water added to 2 cl whiskey results in that the drink is diluted down to 20%. This is exactly the "tasting" dilution that is both recommended and used often. Thus, the choke 4 can also be designed to be wider than a thin linear feature in the height direction of the drinking glass.

The choke 4 prevents the open area from being too open directly above the liquid phase. Otherwise, a larger area would allow for a higher/faster transfer of ethanol from the liquid to the gaseous phase. Thus, the inventive drinking glass is a chokeed shape that widens upwards and comprises a choke above the liquid-phase space. The diameter of the choke can suitably be 3 cm, for example. An opening of this size allows the liquid to freely move in both directions. The diameter of the upper edge of the glass can be 6 cm, for example.

The shapes and dimensions of the drinking glass affect the drinking pleasure. It has been observed that when 3 planes are provided in the upper section of the drinking glass, on the inside face thereof, as shown in FIG. 1, it is able to offer considerably more drinking pleasure than more conventional drinking glasses. As appears from FIG. 1, the planes are placed to overlap one another but they are not aligned in the height direction of the glass. The planes are placed within an area of 180 degrees, that is, on only one side of the glass. In practice, on the side where the user puts his nose when smelling or drinking from the glass. The planes are "crescent" in shape and follow the inside face of the glass. The greatest width of the planes is 0.5 cm, for example. A recess having a volume of 0.1 ml is provided in the middle of the plane, in the upper face thereof. It equals to about 2 droplets. The planes extend over each other, having an overlap of 5 degrees in the height direction of the drinking glass, that is, the length of each plane is 65 degrees. The recess provided in the upper face of one plane may continue towards another plane, as a groove allowing the liquid to run through when the glass is tilted. When the glass is an upright position, no running occurs. This embodiment, comprising a total of approximately 0.3 ml of drink on the planes, in combination with the dimensioning of the volume of the upper section of the drinking glass, has been found to be a well-functioning assembly.

In traditional whiskey tasting, for example, the evaluation is based on color, appearance, background information, scent and flavor. Usually the drink is swirled in a glass having a particular shape in order to obtain all available information. However, the high ethanol content is disturbing but the invention reduces this effect.

Compared to traditional tasting, the invention allows all the same things to be practiced. The invention offers a more comprehensive sensing experience and very much new information on whiskey by means of the other evaporating compounds therein. The invention aims at preventing a high content of a gaseous phase of ethanol from being created in the upper section of the drinking glass and allows the other scent compounds to evaporate as a function of time.

In addition, it becomes possible for the user of the drinking glass to control the sensations (taste & smell) himself, by his preferences. The inventive technical solution also allows the taste and smell sensations to be separated from each other. Further, this technical solution allows for a differentiated evaluation of the scent molecules.

When starting to drink from the inventive drinking glass, dimensioned for 4 to 5 cl and in accordance with FIG. 1, 2 cl of drink is poured into it, the drink then running down over the planes provided on the inside face of the glass. This leaves a total of 0.3 ml of whiskey on the planes. The rest runs down to the bottom of the drinking glass, into the lower section of the drinking glass. This represents a situation where it is possible to drink the whiskey in the traditional way, undiluted.

A second method of use allows the user to have different sensations and to separate the taste sensation from the smell sensation, associated with the fact that the scent compounds are sensed more distinctively than in the traditional method. In the second method of use, after the drink has been poured, an ice cube is inserted into the glass to block the lower section with respect to the upper section. The drink above the planes is allowed to evaporate, that is, the ethanol is removed from the mixture. This takes 2 to 3 minutes, for example, depending on how the glass if warmed by the fingers and how the glass is swirled. In other words, the user is able to control his drinking experience.

After the evaporation time, the user puts the glass on his mouth but, instead of drinking it, he takes his first sniff of it. Then, he takes the glass down. During this sniff, it is possible to sense light scent molecules giving an impression of a flower or fruit, for example. After a minute, the user takes his next sniff and may have a new smell sensation. This may continue up to 10 minutes until which time the evaporating compounds have been found to be clearly detectable. After this time it is more difficult to detect most of the compounds, and the ice cube has dropped into the lower section of the glass. At this point, the previous sniffs are stored in the user's memory and the user may taste the liquid itself. The user perceives the 20% drink (whiskey diluted by an ice cube, for example) retronasally, that is, first, the taste sensations, and, then, the smell sensation when exhaling. The user now combines these both sensations.

Smelling scents is a major part of the overall pleasure of drinking. When eating or drinking, for example, the human sense of smell is capable of transmitting up to 80% of the information on what the food or beverage tastes like. Therefore, the pleasure results from the combination of smell and taste sensations. Compared to the known solutions, in the gaseous phase of the upper section of the drinking glass according to the invention, the amount of the other compounds of the drink is larger than that of the ethanol. This enhances the drinking pleasure.

The drinking glass according to the invention is intended for distilled alcoholic drinks, such as whiskey, gin, rum, cognac and calvados. It is obvious that the above-described invention can be implemented in a variety of ways within the scope of the independent claim.

The invention claimed is:

1. A drinking glass to serve distilled alcoholic drinks comprising a bottom and a wall, and having a solution space and a gaseous phase space, wherein the wall comprises a choke, at which a cross-sectional area limited by the wall is smaller than a cross-sectional area limited by the wall at an upper edge of the wall and smaller or equal to a cross-sectional area limited by the wall at the bottom of the glass, the solution space having a volume limited between the bottom, the wall, and the cross sectional area of the wall at the choke, the gaseous phase space being located above the choke and having a volume limited between the wall, the cross sectional area of the wall at the choke and the cross sectional area of the wall at the upper edge of the wall, the volume of the solution space being smaller than the volume of the gaseous phase space, and a height of the solution space when measured from a center point of the bottom to a center point of the cross sectional area of the wall at the choke, is smaller than a height of the gaseous space when measured from the center point of the cross sectional area of the wall at the choke to a center point of the cross sectional area of the wall at the upper edge of the wall, and the wall having at least one formation for the distilled alcoholic drink on an inside face of the wall within the gaseous phase space, between the choke and the upper edge of the wall, and the at least one formation being a recess or a projection on the inside face of the wall, the at least one formation configured to receive a portion of the distilled alcoholic drink upon pouring the drink into the glass and to hold the portion of the distilled alcoholic drink on a surface of the formation and to allow fast evaporation of ethanol from the portion of the distilled alcoholic drink held on the surface of the formation.

2. The drinking glass of claim 1, wherein the at least one formation is a plane having an upper face and lower face and extending on the inside face of the drinking glass.

3. The drinking glass of claim 1, wherein at least one of the at least one formation has a concave surface on the inside face of the glass.

4. The drinking glass of claim 2, wherein there is an indentation on the upper face or on the lower face of the plane.

5. The drinking glass of claim 1, wherein there are at least two formations and the at least two formations are placed at different heights in a vertical direction of the drinking glass.

6. The drinking glass of claim 5, wherein the at least two formations are located above each other on same line in the vertical direction of the drinking glass.

7. The drinking glass of claim 5, wherein the at least two formations are staggered in relation to each other.

8. The drinking glass of claim 7, wherein an upper face or a lower face of the formations has a groove toward one end of the formation.

9. The drinking glass of claim 4, wherein the indentation has a volume of 0.1 ml.

10. The drinking glass of claim 7, wherein the glass has three formations staggered in relation to each other such that the three formations are located within a sector of 180 degrees of the wall.

11. The drinking glass of claim 1, wherein the volume of the solution space is at least 40 to 50 ml.

12. The drinking glass of claim 1, wherein the cross sectional area limited by the wall at the choke is such that an ice cube can be positioned at the choke.

* * * * *